US006571774B2

(12) United States Patent
Yomogida

(10) Patent No.: US 6,571,774 B2
(45) Date of Patent: Jun. 3, 2003

(54) ENGINE FUEL-INJECTION CONTROL DEVICE

(75) Inventor: Koichiro Yomogida, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 50 days.

(21) Appl. No.: 09/965,756

(22) Filed: Sep. 27, 2001

(65) Prior Publication Data

US 2003/0056763 A1 Mar. 27, 2003

(51) Int. Cl.[7] ..... F02M 51/00

(52) U.S. Cl. ..... 123/491; 123/456; 123/480; 701/104; 701/113

(58) Field of Search ..... 123/472, 478, 123/479, 480, 491, 299, 300, 456; 701/104, 105, 113; 239/585.1; 251/129.01

(56) References Cited

U.S. PATENT DOCUMENTS

| | | | | | |
|---|---|---|---|---|---|
| 3,816,717 | A | * | 6/1974 | Yoshida et al. | 701/104 |
| 4,502,439 | A | * | 3/1985 | Nagase et al. | 123/357 |
| 4,785,786 | A | * | 11/1988 | Nagao et al. | 123/488 |
| 5,163,408 | A | * | 11/1992 | Nemoto | 123/491 |
| 5,586,544 | A | * | 12/1996 | Kitamura et al. | 123/684 |
| 5,638,792 | A | * | 6/1997 | Ogawa et al. | 123/480 |
| 5,722,365 | A | * | 3/1998 | Sadakane et al. | 123/336 |
| 5,735,241 | A | * | 4/1998 | Matsuura | 123/305 |
| 5,852,998 | A | * | 12/1998 | Yoshioka | 123/491 |
| 6,257,197 | B1 | * | 7/2001 | Nishimura et al. | 123/295 |
| 6,269,791 | B1 | * | 8/2001 | Tanaka et al. | 123/300 |
| 6,494,188 | B1 | * | 12/2002 | Kanno | 123/491 |
| 2001/0050072 | A1 | * | 12/2001 | Yomogida | 123/436 |

FOREIGN PATENT DOCUMENTS

| | | | | |
|---|---|---|---|---|
| JP | 58-162738 | | 9/1983 | F02D/5/00 |
| JP | 2001-152936 | * | 6/2001 | F02D/41/16 |

* cited by examiner

*Primary Examiner*—Henry C. Yuen
*Assistant Examiner*—Hai Huynh
(74) *Attorney, Agent, or Firm*—McCormick, Paulding & Huber LLP

(57) ABSTRACT

When the accelerator is actuated at startup of the engine, a value for target fuel-injection amount at startup Qst is output by a device for electing a target fuel-injection amount at startup 45, this value being selected by minimum value selecting means 44 as the smaller of two values that are an additional fuel injection amount at startup Qsa, which is calculated, on the basis of the previous target fuel-injection amount at startup Qst(−1), by a device for calculating an additional fuel injection amount at startup 42, and a limit fuel-injection amount at startup Qsl, which is calculated, on the basis of accelerator pedal depression amount Ac, by a device for calculating a limit fuel-injection amount at startup 43. Addition to the fuel-injection amount can thus be limited in accordance with the accelerator actuation amount, and the generation of smoke suppressed.

20 Claims, 4 Drawing Sheets

FLOWCHART FOR ELECTING A FUEL INJECTION AMOUNT AT STARTUP

ENGINE FUEL-INJECTION CONTROL DEVICE

CROSS REFERENCES TO RELATED APPLICATIONS

This application corresponds to Japanese Patent Application No.11-337502 filed in JPO on Nov. 29, 1999, the entire disclosure of which is incorporated herein by reference.

BACKGROUND OF THE INVENTION

1. Field of the Invention

The present invention relates to an engine fuel-injection control device for controlling the amount of fuel that is injected at startup of an engine.

2. Description of the Related Art

Conventionally, control of fuel injection at startup of an engine, such as a diesel engine, is performed according to the fuel injection amount at startup, which is determined on the basis of the cooling water temperature, rotation speed of the engine and so forth. However, when startup problems arise, it has been proposed to add a predetermined fuel injection amount stepwise to the fuel injection amount at startup according to the amount of time that has elapsed since startup was initiated.

Control of the kind described above, of a fuel injection amount through stepwise addition to the fuel injection amount at startup, is disclosed, for example, in Japanese Patent Application Laid-Open No. S58-162738. The control of a fuel injection amount that is disclosed in this publication previous, during startup of an engine, of a startup supply amount that is added stepwise or linearly according to time or the engine speed, within a predetermined range for the engine speed. If the fuel injection amount is added to on a continuous basis, the fuel injection amount becomes excessive with respect to the amount of air intake by the engine, and there is a risk of smoke generation and an increased amount thereof, as a result of incomplete combustion of fuel. An excessive fuel-injection amount is linked to an adverse impact on fuel economy, and, since the discharge of smoke is environmentally unfavorable, the continuous addition of a fuel-injection amount is unfavorable even at startup.

Also in the fuel injection control disclosed in the above-mentioned publication, when the engine speed (or supplied fuel amount) becomes larger than a predetermined value, at least a limit value corresponding to the engine speed is provided, and a target value for the supplied fuel amount is controlled such that the fuel injection amount added does not exceed the limit value. However, the conventional constitution is such that, at engine startup, since instability of the engine rotation speed leads to abrupt fluctuations thereof, even when addition to the fuel-injection amount is regulated, the limit value itself, for this regulation, fluctuates considerably, which results in the fuel injection amount becoming unstable.

SUMMARY OF THE INVENTION

Therefore, problems to be resolved by the present invention are as follows. When the engine is starting up, an addition must not always be made to the fuel injection amount, conditions for the time when the accelerator is actuated are to be set for the addition of fuel, an increase in the amount of smoke is to be suppressed, and engine startup efficiency is to be improved.

An object of the present invention is to solve the above-mentioned problems by providing an engine fuel-injection control device that, when the engine is starting up performs control of the addition to the fuel injection amount by making accelerator actuation a condition therefore, such that, when the accelerator is not actuated, no such addition to the fuel injection amount is performed, an increase in the amount of smoke is suppressed, and engine startup efficiency is improved.

The present invention relates to an engine fuel-injection control device that comprises means for calculating a base fuel-injection amount at startup, which calculates a base fuel injection amount at startup, at startup of the engine; means for calculating an additional fuel injection amount at startup, which calculates an additional fuel injection amount at startup by adding a predetermined additional fuel injection amount to the previous target fuel-injection amount at startup; means for calculating a limit fuel-injection amount at startup, which calculates, on the basis of the accelerator actuation amount an injectable limit fuel-injection amount at startup that is limited by a boundary value at which smoke generation occurs at the above-mentioned engine startup; and means for electing a target fuel-injection amount at startup that elects the above-mentioned base fuel-injection amount at startup, which is calculated by the above-mentioned means for calculating a base fuel-injection amount at startup as the current above-mentioned target fuel-injection amount at startup if the accelerator is not actuated at the above-mentioned engine startup, or that elects the smaller of two values that are the above-mentioned additional fuel injection amount at startup and the above-mentioned limit fuel-injection amount at startup, as the current above-mentioned target fuel-injection amount at startup, if the accelerator is actuated at the above-mentioned engine startup.

By means of this engine fuel-injection control device, when the accelerator is not actuated at engine startup, the base fuel-injection amount at startup, which is calculated on the basis of the cooling water temperature and the engine rotation speed, is elected as the current target fuel-injection amount at startup; or, when the accelerator is actuated at engine startup, the smaller of two values that are the additional fuel injection amount at startup, which is calculated on the basis of the previous target fuel-injection amount at startup, and a limit fuel-injection amount at startup, is elected as the current target fuel-injection amount at startup. Consequently, addition to the fuel injection amount is only performed when the accelerator is actuated, for example by the accelerator pedal being depressed. Further, the target fuel-injection amount at startup, which is added, is elected such that the added target fuel-injection amount at startup does not exceed the limit fuel-injection amount at startup calculated on the basis of the accelerator actuation amount.

By electing the above-mentioned target fuel-injection amount at startup, consideration to whether the accelerator has been actuated having been taken as a condition for the addition of fuel, and the limit fuel-injection amount at startup having been determined in accordance with the magnitude of the accelerator actuation amount, no addition to the fuel injection amount is made if the accelerator is not actuated; furthermore, since the addition to the fuel injection amount at startup is suppressed in accordance with the magnitude of the accelerator actuation amount, the problems of smoke generation and an unfavorable impact on fuel economy can be resolved. Further, since the accelerator actuation amount does not generate abrupt fluctuations of the rotation speed of the engine at startup, the limit fuel-injection amount at startup is also stabilized.

In this engine fuel-injection control device, the above-mentioned means for calculating the limit fuel-injection amount at startup calculates the above-mentioned limit fuel-injection amount at startup in accordance with the above-mentioned engine cooling water temperature. Since it is known that, typically, the startup characteristics fluctuates considerably according to the engine cooling water temperature, it is possible to take startup efficiency and smoke suppression to a higher level while making both possible, through modification of the limit fuel-injection amount at startup in accordance with the cooling water temperature.

The above-mentioned engine fuel-injection control device preferably comprises minimum value selecting means that select the smaller of two values that are the above-mentioned additional fuel injection amount at startup, which is calculated by the above-mentioned means for calculating the additional fuel injection amount at startup; and the above-mentioned limit fuel-injection amount at startup, which is calculated by the above-mentioned means for calculating the limit fuel-injection amount at startup.

The above-mentioned means for electing a target fuel-injection amount at startup preferably elects the above-mentioned base fuel-injection amount at startup, which is calculated by the above-mentioned means for calculating a base fuel-injection amount at startup, as the current above-mentioned target, fuel-injection amount at startup, irrespective of whether the accelerator has been actuated or not, until a predetermined time has elapsed since the initiation of engine startup.

The above-mentioned means for calculating a base fuel-injection amount at startup preferably calculates the above-mentioned base fuel-injection amount at startup on the basis of the above-mentioned engine water temperature and rotation speed.

The engine fuel-injection control device relating to the present invention is preferably applied to a common-rail type diesel engine comprising: a high-pressure supply pump; a common rail for retaining fuel that is conveyed under pressure from this high-pressure supply pump; injectors for injecting the fuel supplied from the above-mentioned common rail into engine combustion chambers when an electromagnetic actuator is driven; and a controller for providing the above-mentioned electromagnetic actuator, at a predetermined time and over a predetermined duration with a control current for driving the above-mentioned electromagnetic actuator.

The above-mentioned means for calculating a base fuel-injection amount at startup, the above-mentioned means for calculating an additional fuel injection amount at startup, the above-mentioned means for calculating a limit fuel-injection amount at startup and the above-mentioned means for electing a target fuel-injection amount at startup are preferably comprised by the above-mentioned controller.

The engine fuel-injection control device relating to the present invention comprises a device for calculating a base fuel-injection amount at startup, which calculates a base fuel-injection amount at startup, at startup of the engine; a device for calculating an additional fuel injection amount at startup, which calculates an additional fuel injection amount at startup by adding a predetermined additional fuel injection amount to the previous target fuel-injection amount at startup; a device for calculating a limit fuel-injection amount at startup, which calculates, on the basis of the accelerator actuation amount, an injectable limit fuel-injection amount at startup that is a boundary value at which smoke generation occurs at the above-mentioned engine startup; and a device for electing a target fuel-injection amount at startup that elects the above-mentioned base fuel-injection amount at startup, which is calculated by the above-mentioned device for calculating a base fuel-injection amount at startup, as the current above-mentioned target fuel-injection amount at startup if the accelerator is not actuated at the above-mentioned engine startup; or that elects the smaller of two values that are the above-mentioned additional fuel injection amount at startup and the above-mentioned limit fuel-injection amount at startup, as the current above-mentioned target fuel-injection amount at startup if the accelerator is actuated at the above-mentioned engine startup.

The above-mentioned device for calculating a limit fuel-injection amount at startup is preferably constructed so as to calculate the above-mentioned limit fuel-injection amount at startup in accordance with the above-mentioned engine cooling water temperature.

The above-mentioned engine fuel-injection control device preferably comprises a minimum value selecting device that selects the smaller of two values that are the above-mentioned additional fuel injection amount at startup, which is calculated by the above-mentioned device for calculating the additional fuel injection amount at startup; and the above-mentioned limit fuel-injection amount at startup, which is calculated by the above-mentioned device for calculating the limit fuel-injection amount at startup.

The above-mentioned device for electing a target fuel-injection amount at startup preferably elects the above-mentioned base fuel-injection amount at startup, which is calculated by the above-mentioned device for calculating a base fuel-injection amount at startup, as the current above-mentioned target fuel-injection amount at startup, irrespective of whether the accelerator has been actuated or not, until a predetermined time has elapsed since the initiation of engine startup.

The above-mentioned device for calculating a base fuel-injection amount at startup preferably calculates the above-mentioned base fuel-injection amount at startup on the basis of the above-mentioned engine water temperature and rotation speed.

The engine fuel-injection control device relating to the present invention is preferably applied to a common-rail type diesel engine comprising: a high-pressure supply pump; a common rail for retaining fuel that is conveyed under pressure from this high-pressure supply pump; injectors for injecting the fuel supplied from the above-mentioned common rail into engine combustion chambers when an electromagnetic actuator is driven; and a controller for providing the above-mentioned electromagnetic actuator, at a predetermined time and over a predetermined duration, with a control current for driving the electromagnetic actuator.

The above-mentioned device for calculating a base fuel-injection amount at startup, the above-mentioned device for calculating an additional fuel injection amount at startup, the above-mentioned device for calculating a limit fuel injection amount at startup and the above-mentioned device for electing a target fuel-injection amount at startup are preferably constituted by the above-mentioned controller.

The engine fuel-injection control method relating to the present invention comprises: a step of calculating a base fuel-injection amount at startup, in which a base fuel-injection amount at startup is calculated at startup of the engine; a step of calculating an additional fuel injection amount at startup, in which an additional fuel injection amount at startup is calculated by adding a predetermined additional fuel injection amount to the previous target fuel-injection amount at startup; a step of calculating a limit fuel-injection amount at startup, in which, on the basis of the accelerator actuation amount, an injectable limit fuel-injection amount at startup is calculated that is a boundary value at which smoke generation occurs at the above-mentioned engine startup; and a step of electing a target fuel-injection amount at startup, in which the above-mentioned base fuel-injection amount at startup, which is calculated in the above-mentioned step of calculating a base fuel-injection amount at startup, is elected as the current above-mentioned target fuel-injection amount at startup if the accelerator is not actuated at the above-mentioned engine startup; or in which the smaller of two values that are the above-mentioned additional fuel injection amount at startup and the above-mentioned limit fuel-injection amount at startup, is elected as the current above-mentioned target fuel-injection amount at startup, if the accelerator is actuated at the above-mentioned engine startup.

The above-mentioned step of calculating a limit fuel-injection amount at startup is preferably constructed such that the above-mentioned limit fuel-injection amount at startup is calculated in accordance with the above-mentioned engine cooling water temperature.

The above-mentioned engine fuel-injection control method relating to the present invention preferably comprises a step of selecting a minimum value, in which the smaller of two values is selected that are the above-mentioned additional fuel binjection amount at startup, which is calculated by the above-mentioned step of calculating the additional fuel injection amount at startup, and the above-mentioned limit fuel-injection amount at startup, which is calculated in the above-mentioned step of calculating the limit fuel-injection amount at startup.

The above-mentioned step of electing a target fuel-injection amount at startup preferably elects the above-mentioned base fuel-injection amount at startup, which is calculated in the above-mentioned step of calculating a base fuel-injection amount at startup, as the current above-mentioned target fuel-injection amount at startup, irrespective of whether the accelerator has been actuated or not, until a predetermined time has elapsed since the initiation of engine startup.

The above-mentioned step of calculating a base fuel-injection amount at startup preferably calculates the above-mentioned base fuel-injection amount at startup on the basis of the above-mentioned engine water temperature and rotation speed.

The engine fuel-injection control method relating to the present invention is preferably applied to a common-rail type diesel engine comprising: a high-pressure supply pump; a common rail for retaining fuel that is conveyed under pressure from this high-pressure supply pump; injectors for injecting the fuel supplied from the above-mentioned common rail into engine combustion chambers when an electromagnetic actuator is driven; and a controller for providing the above-mentioned electromagnetic actuator, at a predetermined time and over a predetermined duration, with a control current for driving the electromagnetic actuator.

The above-mentioned step of calculating a base fuel-injection amount at startup, the above-mentioned step of calculating an additional fuel injection amount at startup, the above-mentioned step of calculating a limit fuel-injection amount at startup, and the above-mentioned step of electing a target fuel-injection amount at startup are preferably executed by the above-mentioned controller.

DETAILED DESCRIPTION OF THE INVENTION

Figure 1:
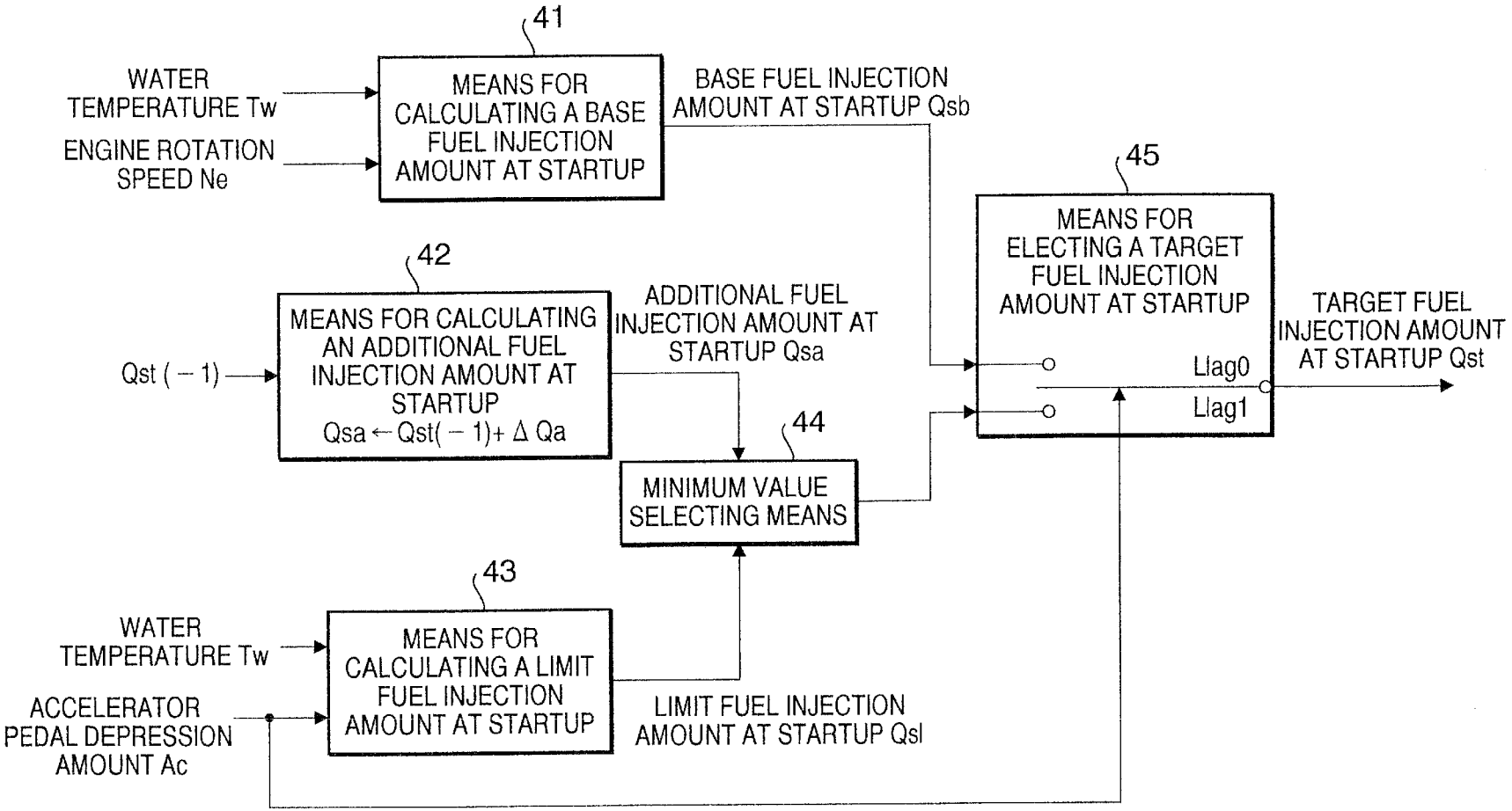
FIG. 1 is a block diagram showing an example of the engine fuel-injection control device according to the present invention.
Figure 2:
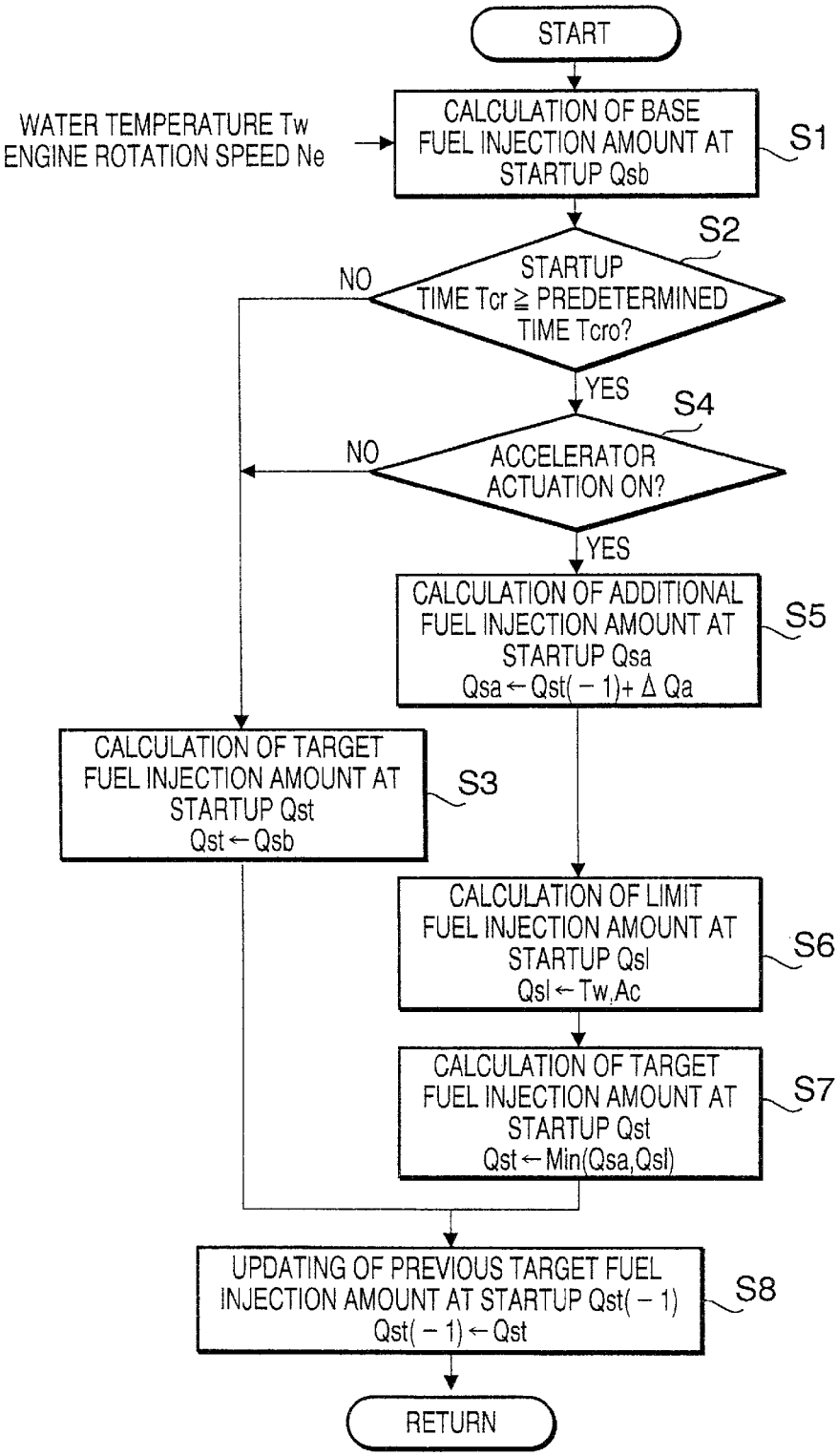
FIG. 2 is a flow chart for electing the fuel injection amount at startup in the engine fuel-injection control device shown in FIG. 1.
Figure 3:
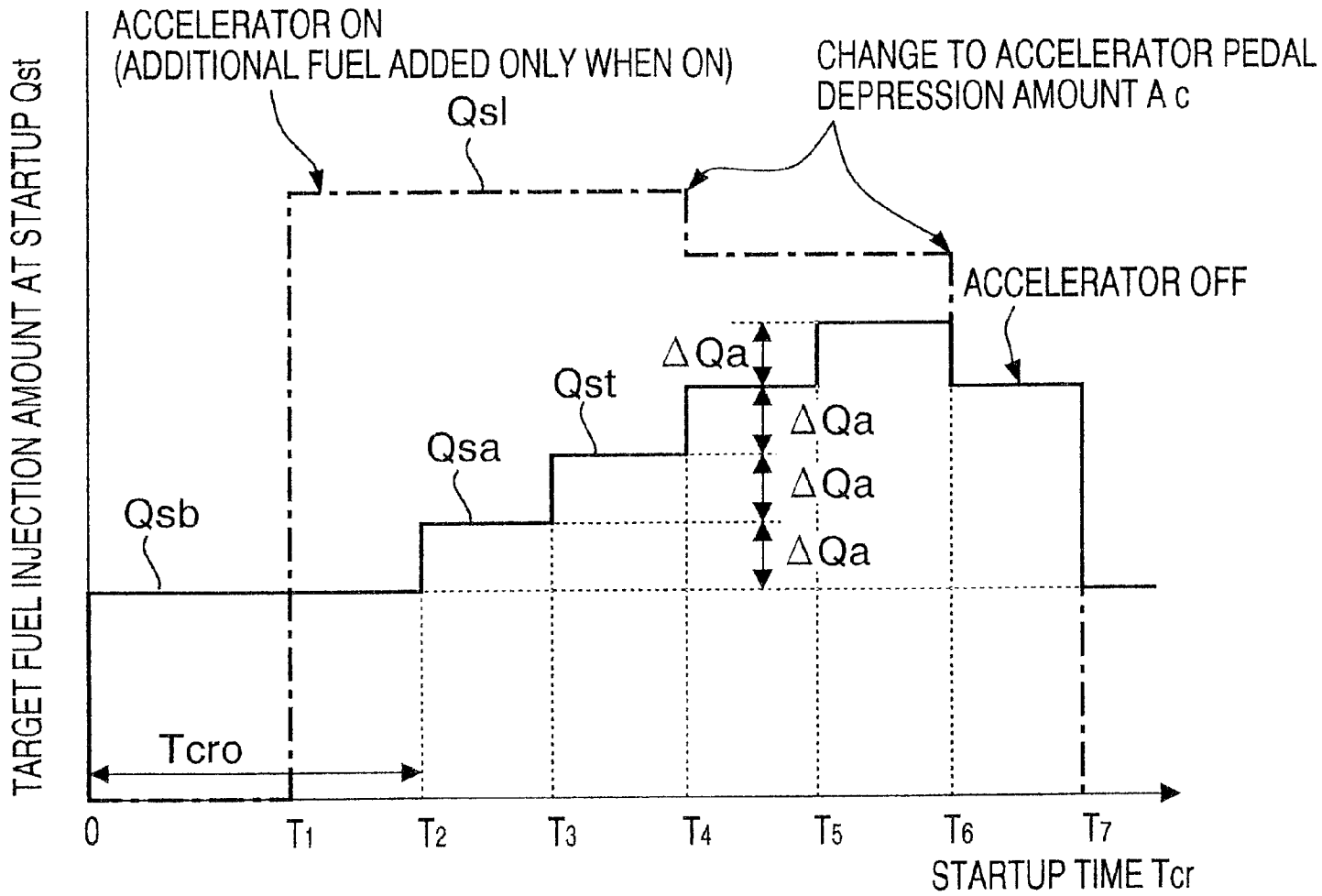
FIG. 3 is a graph illustrating the change, with respect to time, of the fuel injection amount at startup, as determined by the flow chart, for electing the fuel injection amount at startup, shown in FIG. 2 in the engine fuel-injection control device shown in FIG. 1.
Figure 4:
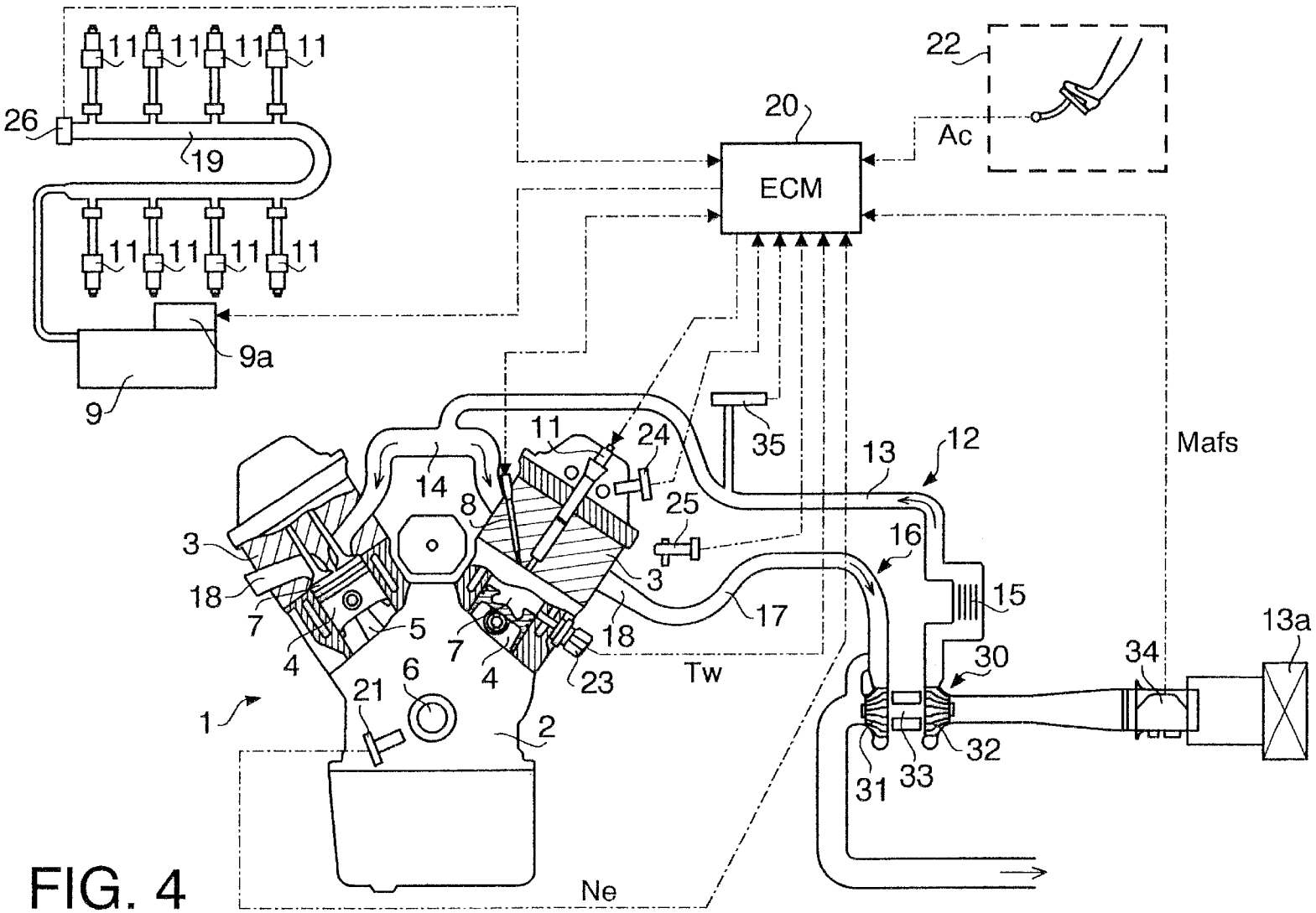
FIG. 4 is a schematic view showing an example of an engine to which the fuel-injection control device according to the present invention has been applied.

Referring to the attached drawings, an embodiment of an engine fuel-injection control device according to the present invention is described hereinbelow. FIG. 1 is a block diagram showing an embodiment of an engine fuel-injection control device according to the present invention; FIG. 2 is a flow chart for determining the fuel injection amount at startup in the engine fuel-injection control device shown in FIG. 1; FIG. 3 is a graph illustrating the change, with respect to time, of the fuel injection amount at startup, as determined by the flow chart for electing the fuel injection amount at startup shown in FIG. 2 in the engine fuel-injection control device shown in FIG. 1; FIG. 4 is a schematic view showing an example of an engine to which the fuel-injection control device according to the present invention has been applied.

FIG. 4 shows an engine that comprises a turbocharger to which the fuel-injection control device according to the present invention is applied. Engine 1 is a V-type 8-cylinder engine that comprises a cylinder block 2 in which cylinder bores are formed; and cylinder head 3 that are mounted in cylinder block 2. The reciprocating movement, of slidable pistons 4 inside cylinder liners that are disposed in the cylinder bores, is converted into the rotational movement of a crankshaft 6 via con'rods 5.

In the electronically controlled fuel-injection system of engine 1, the fuel or engine oil, which is the working fluid that is conveyed under pressure from the high pressure supply pump 9 provided in the fuel supply system, is stored in a common rail 19, and supplied to each injector 11 from common rail 19. Each of injectors 11 is constituted as a unit injector with an injector main body for performing fuel injection and an electromagnetic actuator for controlling the injection of fuel from injection holes and the stoppage of fuel injection. A plurality of injectors 11 (8 thereof in the example shown in the figure) are, corresponding to the number of cylinders, arranged in cylinder heads 3 in the electronic control fuel-injection system of engine 1. Injectors 11 are actuated by the working fluid from common rail 19 and inject fuel directly into combustion chambers 7 under the action of the fuel-injection pressure, which is raised until the pressure, which corresponds to a running state of the engine, is reached. When engine 1 is a diesel engine, the fuel injected into combustion chambers 7 is ignited in a compressed state. Glow plugs 8 pre-warm combustion chambers 7 when startup is at a low temperature. The electronically controlled fuel-injection systems comprises a controller 20 that is an electronic control unit (ECM). Detection signals that detect the running state of engine 1 are input from each sensor to controller 20, and controller 20 controls the pressure (rail pressure) inside common rail 19 by controlling an electromagnetic actuator, which is comprised in [each of] injectors 11, and a fluid volume control valve 9*a*, which is comprised in high-pressure supply pump 9, on the basis of these detection signals.

A crank angle sensor 21 for detecting the rotation speed Ne of engine 1 is constituted by an electromagnetic pickup, which detects a gear formed with some teeth missing and that rotates along with the crankshaft 6 as a result of being fixed thereto. Detection signals that are input to controller 20 in addition to detection signals from crank angle sensor 21 include detection signals from an accelerator actuation amount sensor 22, which detects an accelerator actuation amount, (the amount of depression of the accelerator pedal) Ac; detection signals from water temperature sensors 23 (alternatively, oil temperature sensors that detect the temperature of lubricating oil), which detect a water temperature Tw of cooling water that circulates within cylinder block 2; detection signals from a cam sensor 24, provided in each of cylinder heads 3, which detects the angle of rotation of cams that actuate intake/exhaust valves; and detection signals from atmospheric pressure sensor 25, and pressure sensor 26, which is arranged in common rail 19.

Through control of the time at which the control current is passed from controller 20 to the electromagnetic actuators, and the duration over which this current is passed, the time at which fuel is injected from injectors 11, and the injection amount; may be controlled. Based on a target fuel-injection amount, which is a target value determined from the running state of the engine, controller 20 elects the duration over which current is passed to the electromagnetic actuators (pulse width), and controls the fuel-injection amount by driving the electromagnetic actuator at this pulse width. The crank angle, which is detected by crank angle sensor 21, is used for control of the time at which the passage of a drive current for driving the electromagnetic actuator is initiated and duration over which the drive current is passed, in addition to detection signals from each sensor that detect, in a reference cylinder or in each cylinder, that a piston compression dead point or a predetermined angular position, which is before the piston compression dead point, has been reached.

In the air intake system 12 for the intake of air to engine 1, an air-intake pipe 13 is connected to engine 1 via air-intake manifold 14 and serves to introduce air from the outside through the medium of air cleaner 13*a*. Air-intake manifold 14 communicates with combustion chambers 7 through the medium of an air-intake valve (not shown). An intercooler 15 is provided in air-intake pipe 13, which intercooler cools the air introduced in order to raise the rate of fill. In exhaust system 16, an exhaust pipe 17 for evacuating exhaust gas from engine 1 to the outside is connected to engine 1 via an exhaust manifold 18. This exhaust manifold 18 communicates with combustion chambers 7 through the medium of exhaust valves (not shown). Although not shown, an exhaust gas purification device, and an energy recovery device for recovering energy contained in the exhaust gas are provided in exhaust pipe 17.

A turbocharger 30, which comprises a variable-nozzle turbine, is disposed between air-intake system 12 and exhaust system 16. Turbocharger 30 comprises a turbine 31 which is disposed in exhaust system 16 and in which a turbine blade is driven by high-temperature exhaust gas; a compressor 32, which is disposed in air intake system 12 is driven by turbine 31 and which compresses introduced air and a shaft 33 that connects turbine 31 and compressor 32.

In air-intake pipe 13 a mass/air-flow sensor 34, which is constituted as an introduced air amount detecting means for detecting the amount of air passing therethrough, is disposed upstream of turbocharger 30. Mass/air-flow sensor 34 may also be an air mass detection-type sensor or air buildup detection-type sensor (in such cases an intake air temperature sensor is provided for detecting the temperature of the introduced air, it thus being possible to calculate the air mass from the air volume and intake air temperature). In air-intake pipe 13, a boost pressure sensor 35, for detecting the intake air pressure, is provided downstream of turbocharger 30. A signal, for the introduced air amount, which is detected by mass/air-flow sensor 34, and a signal, for the intake air pressure, which is detected by boost pressure sensor 35, are each input to controller 20.

An outline of the engine fuel-injection control device according to the present invention will now be explained on the basis of the block diagram shown in FIG. 1. Means for calculating a base fuel-injection amount at startup 41 calculates a base fuel-injection amount at startup Qsb that constitutes a base fuel-injection amount at startup of the engine, on the basis of an engine cooling water temperature Tw and engine rotation speed Ne. Meanwhile, means for calculating an additional fuel injection amount at startup 42 calculates an additional fuel injection amount at startup Qsa by adding an additional fuel injection amount ΔQa to the previous target fuel-injection amount at startup Qst(−1), same being ultimately determined by this fuel-injection control device (hereinbelow, (−1) denotes a value determined during execution of the previous operation). Further, means for calculating a limit fuel-injection amount at startup 43 calculates, on the basis of accelerator actuation amount such as cooling water temperature Tw and accelerator pedal depression amount Ac, a limit fuel-injection amount, at startup Qsl that is a boundary value at which smoke generation occurs when, at startup of the engine, fuel is injected in excess of this boundary value. Minimum value selecting means 44 selects the smaller of two values that are an additional fuel injection amount at startup Qsa from means for calculating an additional fuel injection amount at startup 42, and a limit fuel-injection amount at startup Qsl, from means for calculating a limit fuel-injection amount at startup 43.

When the accelerator actuation amount is zero, means for electing a target fuel-injection amount at startup 45 elects a base fuel-injection amount at startup Qsb, from means for calculating a base fuel-injection amount at startup 41, as target fuel-injection amount at startup Qst, in accordance with an accelerator actuation flag of 0; and, when an accelerator actuation amount is present that is not zero, in accordance with an accelerator actuation flag of 1, a value is selected by minimum value selecting means 44, that is, an injection amount that is the smaller of two values that are additional fuel injection amount at startup Qsa and limit fuel-injection amount at startup Qsl is elected as target fuel-injection amount at startup Qst.

In the engine fuel-injection control device with a constitution as shown by the block diagram of FIG. 1, control of the fuel-injection amount is performed according to the flowchart, for electing a target fuel-injection amount at startup Qst, shown in FIG. 2. As shown in FIG. 2, from among detection signals from detection means that comprise each kind of sensor that detect the running state of the engine, base fuel-injection amount at startup Qsb is calculated on the basis of cooling water temperature Tw, which is detected by water temperature sensor 23, and of engine rotation speed Ne (calculated by means for calculating a base fuel-injection amount at startup 41; step 1). A judgment is made as to whether or not a startup time Tcr, which has elapsed since engine startup was initiated, has reached or exceeded a predetermined time $Tcr_0$, which is determined in advance (step 2). When startup time Tcr has not reached predetermined time Tcro, target fuel-injection amount at startup Qst is elected as base fuel-injection amount at startup Qsb (step 3).

When startup time Tcr, which has elapsed since startup of engine 1 was initiated, is equal to or greater than predetermined time $Tcr_0$, which is determined in advance, a judgment is then made as to whether the accelerator is in an ON state (step 4). In other words, if accelerator pedal depression amount Ac is zero, step 3 proceeds and target fuel-injection amount at startup Qst continues to be base fuel-injection amount at startup Qsb (by means for electing a target fuel-injection amount at startup 45). If accelerator pedal depression amount Ac is not zero, as determined by the judgment in step 4, additional fuel injection amount ΔQa is added to the previous target fuel-injection amount at startup Qst(−1), whereby additional fuel injection amount at startup Qsa is calculated (by means for calculating an additional fuel injection amount at startup 42; step 5). Then, on the basis of water temperature Tw and accelerator pedal depression amount Ac, a limit fuel-injection amount at startup Qsl is calculated (by means for calculating a limit fuel-injection amount at startup 43; step 6). Thereafter, the smaller of two values that are the additional fuel injection amount at startup Qsa, which is calculated in step 5, and the limit fuel-injection amount at startup Qsl, which is calculated in step 6, is elected as the target fuel-injection amount at startup Qst (by minimum value selecting means 44 and means for electing a target fuel-injection amount at startup 45; step 7). Further, the previous target fuel-injection amount at startup Qst(−1) is updated by the current target fuel-injection amount at startup Qst (step 8).

A description follows hereinbelow, on the basis of FIG. 3, of the change, with respect to time elapsed since the initiation of startup of the engine, in the target fuel-injection amount at startup, during actuation of the accelerator, in the engine fuel-injection control device according to the present invention. The horizontal axis of the graph in FIG. 3 shows the startup time when 0 represents the instant at which startup is initiated. The vertical axis shows limit fuel-injection amount at startup Qsl with a dot-chain line and target fuel-injection amount at startup Qst with a solid line. For the time subsequent to startup, when startup time Tcr does not reach predetermined time $Tcr_0$, irrespective of whether accelerator pedal depression amount Ac is zero, base fuel-injection amount at startup Qsb, which is calculated by means for calculating base fuel-injection amount at startup 41, remains as target fuel-injection amount at startup Qst. When the accelerator pedal is depressed to a large extent at a startup time $T_1$, limit fuel-injection amount at startup Qsl is a maximum value, but there is no change of target fuel-injection amount at startup Qst.

When predetermined time $Tcr_0$, since startup initiation, is exceeded and startup time Tcr is equal to instant $T_2$, and when no change is made to accelerator pedal depression amount Ac, additional fuel injection amount at startup Qsa is calculated by means for calculating an additional fuel injection amount at startup 42 by adding additional fuel injection amount ΔQa to base fuel-injection amount at startup Qsb, which is the previous target fuel-injection amount at startup Qst(−1). Since, at this time, limit fuel-injection amount at startup Qsl, which is calculated by means for calculating a limit fuel-injection amount at startup 43, is of a greater value than additional fuel injection amount at startup Qsa, additional fuel injection amount at startup Qsa, which is selected by minimum value selecting means 44, is elected as target fuel-injection amount at startup Qst by means for electing a target fuel-injection amount at startup 45. Thereafter, similarly at an instant after a suitable time has elapsed $T_3$, additional fuel injection amount at startup Qsa becomes equal to a value calculated by the further adding of additional fuel injection amount ΔQa.

At an instant $T_4$, when accelerator pedal depression amount Ac is changed so as to decrease slightly, limit fuel-injection amount at startup Qsl decreases. However, since additional fuel injection amount at startup Qsa, to which additional fuel-injection amount ΔQa has been further added, is still of a smaller value than limit fuel-injection amount at startup Qsl, additional fuel injection amount at startup Qsa is elected, by minimum value selecting means 44 and means for electing a target fuel-injection amount at startup 45, as target fuel-injection amount at startup Qst. At an instant $T_5$, additional fuel injection amount at startup Qsa is similarly elected as target fuel-injection amount at startup Qst.

At an instant $T_6$, when accelerator pedal depression amount Ac is changed so as to decrease still further, and limit fuel-injection amount at startup Qsl is of a smaller value than the previous target fuel-injection amount at startup Qst(−1), limit fuel-injection amount at startup Qsl is elected, by minimum value selecting means 44 and means for electing a target fuel-injection amount at startup 45, as target fuel-injection amount at startup Qst. Consequently, fuel is injected in an amount that is the largest permissible fuel-injection amount at startup, and the fuel-injection amount is not excessive, whereby the generation of smoke is prevented. Furthermore, at an instant $T_7$, when the accelerator is in an OFF state, base fuel-injection amount at startup Qsb is elected as target fuel-injection amount at startup Qst by means for electing a target fuel-injection amount at startup 45.

The engine fuel-injection control device according to the present invention, being constituted as described above, affords the following effects. That is, by means of this engine fuel-injection control device, when the accelerator is not actuated at engine startup, the base fuel-injection amount at startup, which is calculated on the basis of the cooling water temperature and engine rotation speed, is elected as the current target fuel-injection amount at startup; when the accelerator is actuated at engine startup, the smaller of two values that are the additional fuel injection amount at startup, which is calculated on the basis of the previous target fuel-injection amount at startup, and the limit fuel-injection amount at startup, is elected as the current target fuel-injection amount at startup. Consequently, with accelerator actuation, such as the depression of the accelerator pedal, considered as a condition for an addition to the fuel-injection amount, no addition to the fuel-injection amount is made when the accelerator is not actuated, this addition to the fuel-injection amount only being made when the accelerator is actuated. Furthermore, since the addition to the fuel-injection amount at startup can be suppressed in accordance with the magnitude of the accelerator actuation amount, engine startup efficiency can be improved, and the problems of smoke generation and adverse impact on fuel economy can be resolved. Further, since the accelerator actuation amount does not generate abrupt fluctuations of the rotation speed of the engine at startup, the limit fuel-injection amount at startup is also stabilized.

What is claimed is:

1. An engine fuel-injection control device, comprising:

means for calculating a base fuel-injection amount at startup, which calculates a base fuel-injection amount at startup, at startup of an engine;

means for calculating an additional fuel injection amount at startup, which calculates an additional fuel injection amount at startup by adding a predetermined additional fuel injection amount to a previous target fuel-injection amount at startup;

means for calculating a limit fuel-injection amount at startup, which calculates, on the basis of an accelerator actuation amount, an injectable limit fuel-injection amount at startup that is a boundary value at which smoke generation occurs at said engine startup; and means for electing a target fuel-injection amount at startup that elects said base fuel-injection amount at startup, which is calculated by said means for calculating a base fuel-injection amount at startup, as a current said target fuel-injection amount at startup if the accelerator is not actuated at said engine startup; or that, elects the smaller of two values that are said additional fuel injection amount at startup and said limit fuel-injection amount at startup, as the current said target fuel-injection amount at startup if the accelerator is actuated at said engine startup.

2. The engine fuel-injection control device according to claim 1, wherein said means for calculating a limit fuel-injection amount at startup calculates said limit fuel-injection amount at startup in accordance with said engine cooling water temperature.

3. The engine fuel-injection control device according to claim 1, further comprising:

minimum value selecting means that select the smaller of two values that are said additional fuel injection amount at startup, which is calculated by said means for calculating an additional fuel injection amount at startup, and said limit fuel-injection amount at startup, which is calculated by said means for calculating a limit fuel-injection amount at startup.

4. The engine fuel-injection control device according to claim 1, wherein said means for electing a target fuel-injection amount at startup elects said base fuel-injection amount at startup, which is calculated by said means for calculating a base fuel-injection amount at startup, as the current said target fuel-injection amount at startup, irrespective of whether the accelerator has been actuated or not, until a predetermined time has elapsed since initiation of engine startup.

5. The engine fuel-injection control device according to claim 1, wherein said means for calculating a base fuel-injection amount at startup calculates said base fuel-injection amount at startup on the basis of said engine water temperature and rotation speed.

6. The engine fuel-injection control device, according to claim 1, which is applied to a common-rail type diesel engine comprising:

a high-pressure supply pump;

a common rail for retaining fuel that is conveyed under pressure from said high-pressure supply pump;

injectors for injecting fuel supplied from said common rail into engine combustion chambers when an electromagnetic actuator is driven; and a controller for providing the said electromagnetic actuator, at a predetermined time and over a predetermined duration, with a control current for driving the electromagnetic actuator.

7. The engine fuel-injection control device according to claim 6, wherein said means for calculating a base fuel-injection amount at startup, said means for calculating an additional fuel injection amount at startup, said means for calculating a limit fuel-injection amount at startup and said means for electing a target fuel-injection amount at startup are comprised by said controller.

8. An engine fuel-injection control device, comprising:

a device for calculating a base fuel-injection amount at startup, which calculates a base fuel-injection amount at startup, at startup of an engine;

a device for calculating an additional fuel injection amount at startup, which calculates an additional fuel injection amount at startup by adding a predetermined additional fuel injection amount to a previous target fuel-injection amount at startup;

a device for calculating a limit fuel-injection amount at startup, which calculates, on the basis of an accelerator actuation amount, an injectable limit fuel-injection amount at startup that is a boundary value at which smoke generation occurs at said engine startup; and a device for electing a target fuel-injection amount at startup that elects said base fuel-injection amount at startup, which is calculated by said device for calculating a base fuel-injection amount at startup, as a current said target fuel-injection amount at startup if the accelerator is not actuated at said engine startup; or that elects the smaller of two values that are said additional fuel injection amount at startup and said limit fuel-injection amount at startup, as the current said target fuel-injection amount at startup if the accelerator is actuated at said engine startup.

9. The engine fuel-injection control device according to claim 8, wherein said device for calculating a limit fuel-injection amount at startup calculates said limit fuel-injection amount at startup in accordance with said engine cooling water temperature.

10. The engine fuel-injection control device according to claim 8, comprising:

minimum value selecting means that select the smaller of two values that are said additional fuel injection amount at startup, which is calculated by said device for calculating an additional fuel injection amount at startup, and said limit fuel-injection amount at startup, which is calculated by said device for calculating a limit fuel-injection amount at startup.

11. The engine fuel-injection control device according to claim 8, wherein said device for electing a target fuel-injection amount at startup elects said base fuel-injection amount at startup, which is calculated by said device for calculating a base fuel-injection amount at startup, as the current said target fuel-injection amount at startup, irrespective of whether the accelerator has been actuated or not, until a predetermined time has elapsed since initiation of engine startup.

12. The engine fuel-injection control device according to claim 8, wherein said device for calculating a base fuel-injection amount at startup calculates said base fuel-injection amount at startup on the basis of said engine water temperature and rotation speed.

13. The engine fuel-injection control device, according to claim 8, which is applied to a common-rail type diesel engine comprising:

a high-pressure supply pump;

a common rail for retaining fuel that is conveyed under pressure from said high-pressure supply pump;

injectors for injecting the fuel supplied from said common rail into engine combustion chambers when an electromagnetic actuator is driven; and a controller for providing the said electromagnetic actuator, at a predetermined time and over a predetermined duration, with a control current, for driving the electromagnetic actuator.

14. The engine fuel-injection control device according to claim 13, wherein said device for calculating a base fuel-injection amount at startup, said device for calculating an additional fuel injection amount at startup, said device for calculating a limit fuel-injection amount at startup and said device for electing a target fuel-injection amount at startup are comprised by said controller.

15. An engine fuel-injection control method, comprising:

a step of calculating a base fuel-injection amount at startup, which calculates a base fuel-injection amount at startup, at startup of an engine;

a step of calculating an additional fuel injection amount at startup, which calculates an additional fuel injection amount at startup by adding a predetermined additional fuel injection amount to a previous target fuel-injection amount at startup;

a step of calculating a limit fuel-injection amount at startup, which calculates, on the basis of an accelerator actuation amount, an injectable limit fuel-injection amount at startup that is a boundary value at which smoke generation occurs at said engine startup; and a step of electing a target fuel-injection amount at startup that elects said base fuel-injection amount at startup, which is calculated in said step of calculating a base fuel-injection amount at startup, as a current said target fuel-injection amount at startup if the accelerator is not actuated at said engine startup; or that elects the smaller of two values that are said additional fuel injection amount at startup and said limit fuel-injection amount at startup, as the current said target fuel-injection amount at startup if the accelerator is actuated at said engine startup.

16. The engine fuel-injection control method according to claim 15, wherein said step of calculating a limit fuel-injection amount at startup calculates said limit fuel-injection amount at startup in accordance with said engine cooling water temperature.

17. The engine fuel-injection control method according to claim 15, comprising a minimum value selecting step of selecting the smaller of two values that are said additional fuel injection amount at startup, which is calculated in said step of calculating an additional fuel injection amount at startup, and said limit fuel-injection amount at startup, which is calculated in said step of calculating a limit, fuel-injection amount at startup.

18. The engine fuel-injection control method according to claim 15, wherein said step of electing a target fuel-injection amount at startup elects said base fuel-injection amount at startup, which is calculated in said step of calculating a base fuel-injection amount at startup, as the current said target fuel-injection amount at startup, irrespective of whether the accelerator has been actuated or not, until a predetermined time has elapsed since initiation of engine startup.

19. The engine fuel-injection control method, according to claim 15, which is applied to a common-rail type diesel engine comprising:

a high-pressure supply pump;

a common rail for retaining fuel that is conveyed under pressure from said high-pressure supply pump;

injectors for injecting the fuel supplied from said common rail into engine combustion chambers when an electromagnetic actuator is driven; and a controller for supplying, at a predetermined time and over a predetermined duration, a control current for driving the electromagnetic actuator.

20. The engine fuel-injection control method according to claim 19, wherein said step of calculating a base fuel-injection amount at startup, said step of calculating an additional fuel injection amount at startup, said step of calculating a limit fuel-injection amount at startup, and said step of electing a target fuel-injection amount at startup, are executed by said controller.

* * * * *